United States Patent [19]

Lindberg

[11] Patent Number: 4,870,672

[45] Date of Patent: Sep. 26, 1989

[54] THERMAL EMITTANCE COATING FOR X-RAY TUBE TARGET

[75] Inventor: Richard W. Lindberg, New Berlin, Wis.

[73] Assignee: General Electric Company, Milwaukee, Wis.

[21] Appl. No.: 89,402

[22] Filed: Aug. 26, 1987

[51] Int. Cl.[4] ..... H01J 35/10; H01J 35/24

[52] U.S. Cl. ..... 378/129; 378/127; 378/143; 378/144; 501/105; 427/34; 427/126.3; 427/126.4; 427/423; 106/286.4

[58] Field of Search ..... 378/127, 129, 143, 144; 501/105; 427/34, 126.1, 126.3, 126.4, 423; 106/286.4

[56] References Cited

U.S. PATENT DOCUMENTS

| | | | |
|---|---|---|---|
| 3,919,124 | 11/1975 | Friedal et al. | 378/143 |
| 3,993,923 | 11/1976 | Magendans et al. | 378/144 |
| 4,029,828 | 6/1977 | Bildstein et al. | 378/143 |
| 4,071,760 | 1/1978 | LeMay | 378/4 |
| 4,090,103 | 5/1978 | Machenschalk et al. | 378/144 |
| 4,132,916 | 1/1979 | Hueschen et al. | 378/144 |
| 4,242,221 | 12/1980 | Cusano et al. | 252/301.4 |
| 4,421,671 | 12/1983 | Cusano et al. | 252/301.4 |
| 4,516,255 | 5/1985 | Petter et al. | 378/127 |
| 4,600,659 | 7/1986 | Hong et al. | 428/471 |

FOREIGN PATENT DOCUMENTS

| | | | |
|---|---|---|---|
| 2305018 | 10/1976 | France | 378/144 |
| 0121967 | 9/1980 | Japan | 501/105 |
| 0398526 | 9/1973 | U.S.S.R. | 501/105 |

*Primary Examiner*—Craig E. Church
*Assistant Examiner*—John C. Freeman
*Attorney, Agent, or Firm*—John F. McDevitt

[57] ABSTRACT

A fused metal oxide ceramic coating is disclosed for application in a particular region of the target employed in an x-ray tube. The disclosed ceramic coating enhances the thermal emittance of a refractory metal target and comprises the fused product of a metal oxide physical mixture comprising $Al_2O_3$, $ZrO_2$, and $TiO_2$ which exhibits a minimum melting point of approximately 1580° C. A preferred ceramic coating comprises from about 40 weight percent up to about 70 weight percent $TiO_2$, from about 20 weight percent up to about 40 weight percent $ZrO_2$, and from about 10 weight percent up to about 20 weight percent $Al_2O_3$. A process for the in situ preparation of said ceramic coating is also disclosed along with a particular rotating type x-ray tube and radiographic imaging system employing said improved target.

33 Claims, 2 Drawing Sheets

THERMAL EMITTANCE COATING FOR X-RAY TUBE TARGET

BACKGROUND OF THE INVENTION

This invention relates generally to a coating for improving the thermal emittance of an x-ray tube anode and more particularly to the application of said type coating to the anode target region employed in said x-ray tube.

X-ray tubes accelerate a beam of electrons through a vacuum to high electron velocity under a high electric field toward a metallic target. When the electrons are decelerated by impact with the target, a beam of x-rays is emitted by the target. Only about one percent of the electron energy produces x-rays and the remainder is dissipated as heat. It is customary to aid this dissipation by applying a thermal emittance coating to the target.

A known emissive coating for said purpose is disclosed in U.S. Pat. No. 4,132,916, which is assigned to the assignee of the present invention, and comprises up to 20 percent by weight of a high thermalemittance material $TiO_2$ with the remainder of the composition being made up of an oxide for raising the melting point to an acceptable level and a small amount of a stablizing material for stability of the oxide over the device operating temperature range. This coating is disclosed to be made by sintering a mixture of calcium oxide, zirconium oxide and titanium dioxide to form a ceramic mass. The ceramic mass is ground and and screened for a suitable range of particle sizes, such as, for example, from about 10 to 37 microns. The powder is aplied to the target by conventional plasma spray techniques. Finally, the anode target, including the powder coating, is heated to sufficiently elevated temperatures to fuse the powder to the surface and to out gas the target. Said prior art emissive coating powder requires a firing temperature of about 1640° C. to produce a smooth adherent coating. Modern x-ray targets conventionally employ molybdenum alloys or tungsten alloys which can liberate carbon impurities at temperatures exceeding about 1600° C. Such impurities can thereafter react with the emissive coating at the interface to produce carbon dioxide gas which disrupts adhesion of said coating. The deposition surface of such conventional refractory metal x-ray targets is also generally prepared by sandblasting with $Al_2O_3$ grit to facilitate subsequent adhesion of the final emissive coating. Residual impurities from such sandblasting material can thereby further contaminate the deposited coating and lower its melting point which is understandably objectionable.

In a more recently issued U.S. Pat. No. 4,600,659, also assigned to the present assignee, there is disclosed a related ceramic coating to enhance the thermal conductance of such x-ray tube targets. Said ceramic coating comprises a fused material containing from about 40 percent to 70percent $TiO_2$ with the remaining material being a stabilizing oxide selected from the group of CaO and $Y_2O_3$. Again, the difficulties being experienced with the earlier discovered emissive coatings are not thereby avoided since the melting point of said coating can still be reduced by the same impurities to below 1400° C. A preferred embodiment for said type emissive coating describes the stabilized oxide material as comprising 92 weight percent $ZrO_2$ and 8 weight percent CaO. While such coatings from the ternary $TiO_2$—CaO—$ZrO_2$ system exhibit emissivity values of over 0.800 along with good adhesion at room temperature, they melt or peel off of the target at operating temperatures of modern x-ray targets which can reach 1400° C. and higher. The present invention represents an improvement over these prior art emissive coatings in all said regards, although both above mentioned patents are specifically incorporated herein by reference due to preparation for the present coatings being essentially the same as therein disclosed.

As also disclosed in the above referenced U.S. Pat. No. 4,132,916, the thermal energy being generated by a rotating anode x-ray tube during operation is dissipated primarily by radiation from the target to a surrounding fluid-cooled casing. The basic construction for a conventional rotating anode x-ray tube device comprises a sealed evacuated glass envelope incorporating cathode and anode structural assemblies to generate X radiation within said glass envelope, said cathode structural assembly including an electron emissive filament operatively associated with means to focus an electron beam generated by said filament upon the anode structural assembly, said anode structural assembly including a refractory metal target for impingement of said electron beam thereon to produce X radiation and further structural means being disposed with said glass envelope to cause relative rotation between said cathode assembly and refractory metal target. As further disclosed in said referenced patent, the cathode assembly remains stationary during tube operation while the anode assembly rotates with respect thereto. Since convection cooling from said high vacuum tube is not possible, however, a great amount of heat must be radiated through the glass envelope and hence to the oil circulating in the tube casing. Representative x-ray tubes of said type are now being sold by General Electric Company under the product designations: CT9000, CT9800, DR1190B/BR, and D1191B/BR. The CT designation for said products makes reference to the utility of said rotating anode x-ray tubes for various computerized tomography applications. Accordingly, it has now been found that the presently improved thermal emittance coating is particularly suitable for use in such type radiographic equipment.

One such already known type radiographic imaging system which can be improved according to the present invention utilizes an x-ray source, which frequently comprises a rotating anode x-ray tube, a ceramic scintillator body to convert the x-rays to an optical image, and photodetection means coupled thereto for converting said optical image to an electronic display thereof. Said radiographic imaging system can further include means for digital recording of said optical image to include digital processing means to enhance the quality of said optical image. Computerized tomography imaging systems of said type are disclosed in U.S. Pat. Nos. 4,242,221 and 4,421,671, also assigned to the present assignee, along with suitable ceramic scintillator materials. In the operation of said type equipment, the X radiation emerging from said rorating anode x-ray tube is frequently columnated to produce a thin beam of x-rays which are then projected toward moving x-ray detector means. A subject or body to be examined is positioned in the path of the x-ray fan beam in such a manner that the beam is attentuated as it passes through said subject with the amount of attenuation being dependent upon the density of the said subject. The moving radiation detector means frequently comprises a detector array having a plurality of channels defined therein with said channels being structurally configured so as to receive the attenuated fan beam of x-rays to produce electrical signals which are dependent upon the radiation received within each channel. The electrical signal readings emerging from said channels at a plurality of angular positions with respect to the subject being examined while the x-ray source and detector means are rotated about said subject can therefore be digitized and transmitted to computer means which uses one of a number of available algorithms to compute and construct a picture of the cross section traversed by the fan beam of x-rays. The resulting picture can thereafter be displayed on a cathode ray tube or, alternately, may be used to create an image on permanent media such as photographic film or the like. Accordingly, it follows that the presently improved thermal emittance coatings can be incorporated into said type radiographic imaging equipment as a means for achieving improved operation.

It is a principal object of the present invention, therefore, to provide an improved thermal emittance coating for an x-ray tube anode target which exhibits high thermal emittance along with improved adhesion to said target during tube operation.

It is still another important object of the invention to provide a ceramic coating for an x-ray tube anode which can be deposited on the variety of refractory metal targets as a blended metal oxide mixture for simpler material handling and processing costs.

Still another important object of the present invention is to provide an improved thermal emittance coating not as subject to the impurity contamination problems ordinarily encountered during processing of this coating on a fractory metal anode target.

It is a still further object of the present invention to provide a method for coating an x-ray tube anode target with a more adherent coating of improved emissivity.

A still further object of the present invention is to provide x-ray tube and x-ray imaging devices exhibiting improved performance attributable to the present ceramic coating.

These objects and other features and advantages for the present invention will become more readily apparent upon reference to the following description when taken in connection with the accompanying drawings.

SUMMARY OF THE INVENTION

The present invention involves coating an x-ray tube anode target with a novel fused ceramic material exhibiting high thermal emissivity along with improved theological properties enabling continued adhesion during tube operation. More particularly, said improved ceramic coating comprises a particular eutectic composition having $Al_2O_3$, $ZrO_2$, and $TiO_2$ combined in controlled proportions so as to exhibit a minimum melting point at approximately 1580° C. along with a fusion temperature no greater than approximately 1750° C. and thereby produce a final coating on said x-ray tube target having the aforementioned improved performance characteristics. In deriving said improvement, a physical mixture of said $Al_2O_3$, $ZrO_2$, and $TiO_2$ can be deposited in the correct proportions on the x-ray target and the coated target thereafter fired in a vacuum to produce a dense, fused, high thermal emittance coating exhibiting increased anode heat storage capacity and cooling rate.

The general class of fused metal oxide ceramics which provides improved thermal emittance and adherence according to the present invention is defined by a particular region of the $TiO_2$ —$Al_2O_3$ —$ZrO_3$ phase diagram. Specifically, said region represents various eutectic compositions located within an area defined by the perimeter boundaries ABCDEF on the phase diagram for said metal oxide system as shown in FIG. 1 of the accompanying drawings and which includes both binary and ternary phase ceramics. As thereby defined, the criteria for proper selection of a suitable ceramic composition can be met with the included ceramics exhibiting a minimum melting point of approximately 1580° C. together with a fusion temperature no greater than approximately 1750° C. As still further evident in the depicted phase diagram, the ceramic phases included within the defined area are closely related to $TiO_2$ —$Al_2O_3$ binary eutectic phase compositions. Suitable ceramic phases representing the $TiO_2$ —$ZrO_2$ —$Al_2O_3$ oxide system and also meeting the defined behavioral criteria are found in said defined compositional region. The overall composition range for said ceramics as defined by the specified boundaries in the depicted phase diagram is thereby from about 10 weight percent up to about 80 weight percent $TiO_2$, from about 10 weight percent up to about 60 weight percent $ZrO_2$, and from about 5 weight percent up to about 30 weight percent $Al_2O_3$. Preferred fused metal oxide ceramics within said compositional limits comprise from about 40 weight percent up to about 70 weight percent $TiO_2$, from about 20 weight percent up to about 40 weight percent $ZrO_2$, and from about 10 weight percent up to about 20 weight percent $Al_2O_3$ with an especially preferred ceramic consisting of approximately 50 weight percent $TiO_2$, approximately 40 weight percent $ZrO_2$, and 10 weight percent $Al_2O_3$. Said especially preferred ceramic provides two or more phases so that coatings made therefrom have an extended melting range for both ease of processing and resisting flow when deposited on the refractory metal anode target and subsequently fused thereto. Additionally, the present coatings also provide relative insensitivity to the lowering of the melting point from any residual $Al_2O_3$ when these refractory metal targets are customarily sandblasted prior to deposition of the ceramic thermal emittance coating.

In a preferred embodiment of the present invention, the above defined final ceramic coating is obtained in situ on the x-ray target utilizing the same general procedure disclosed in the previously cited U.S. Pat. No. 4,132,916. More particularly, a powdered mixture comprising $Al_2O_3$, $ZrO_2$, and $TiO_2$ in the proper proportions is applied as a layer on the surface of the target which is outside of the focal track. The coated target is then fired in a vacuum furnace at a sufficiently elevated temperature and for a sufficient time period to fuse the deposited metal oxide mixture and produce a dense, smooth, high emittance, and adherent coating which better resists spalling during subsequent x-ray tube operation. Suitable target material for improvement in said manner are refractory metals, including molybdenum, molybdenum alloys, tungsten and tungsten alloys. The metal oxide physical mixture being deposited on such refractory metal targets can be applied with a plasma gun in an inert atmosphere, normally argon, in the conventional manner. Suitable firing temperature to fully fuse the deposited but still unfused coating in a vacuum can range for the tested metal oxide materials from about 1600° C. up to about 1680° C. and with the applied vacuums ranging from about $10^{-5}$ Torr to about $10^{-6}$ Torr. To still further illustrate a suitable coating preparation wherein said final coating consisted of approximately 50 weight percent $TiO_2$, approximately 40 weight percent $ZrO_2$, and approximately 10 weight percent $Al_2O_3$, a powdered mixture of said oxides in approximately the same weight proportion was deposited by plasma spraying on a commercial molybdenum alloy target, such as commercially available TZM or MT104 alloys, and with said coated target being subsequently fused at 1620°-1680° C. in a vacuum atmosphere of $10^{-5}$ Torr or lower.

As above indicated, various otherwise conventional x-ray tube and x-ray imaging devices to be more fully described hereinafter can be improved by employment of the presently coated x-ray targets. For example, a now widely employed rotating anode x-ray tube which can be improved by performance utilizing said coating features a sealed vacuum evacuated glass envelope incorporating cathode and anode structural assemblies to generate X radiation within said glass envelope, said cathode structural assembly including an electron emissive filament operatively associated with means to focus an electron beam generated by said filament upon the anode structural assembly, said anode structural assembly including a refractory metal target for impingement of said electron beam thereon to produce X radiation, and further structural means being disposed within said glass envelope to cause relative rotation between said cathode assembly and refractory metal target. Providing the refractory metal target in said type x-ray tube with the present coating in the above described manner enhances the thermal emittance from said target and for longer time durations of operation than experienced with the prior art emissive coatings. Correspondingly, various types of modern CT scanners can similarily be improved in performance with the presently coated x-ray targets. A typical radiographic imaging system of this type utilizes an x-ray source, a scintillator body to convert the x-rays to an optical image, and photodetection means coupled thereto for converting said optical image to electronic display thereof. Said radiographic imaging system further generally includes means for digital recording of said optical image which can still further include digital processing means to enhance the quality of the finally displayed image in an already known manner. The x-ray source conventionally employed in said type radiographic imaging system is a rotating anode x-ray tube construction having the same structural configuration above indicated hence subject to incorporating the present improvement.

DESCRIPTION OF THE PREFERRED EMBODIMENTS

Figure 1:
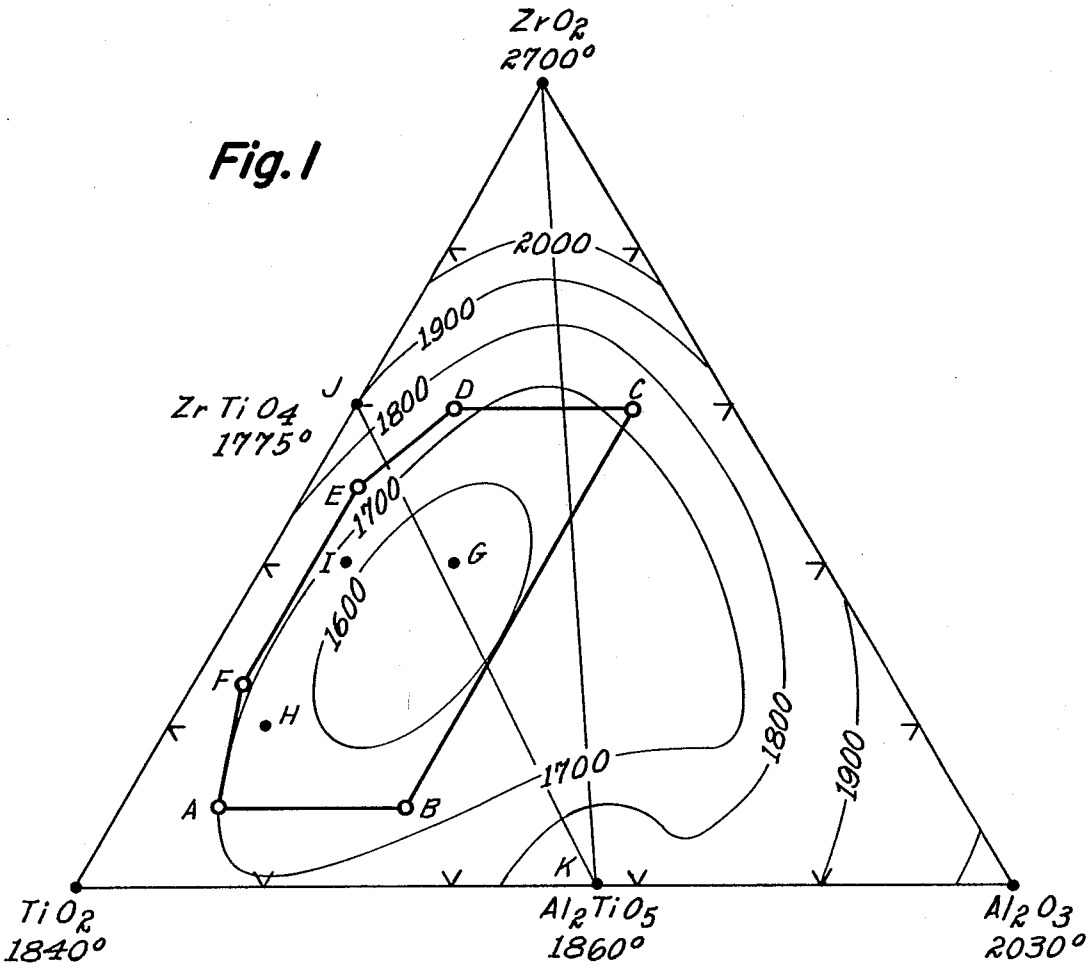
FIG. 1 is a ceramic phase diagram depicting the present ceramic coating composition.

Referring to FIG. 1, there is depicted a ternary phase diagram for the ceramic composition formed with the oxides of $ZrO_2$, $TiO_2$, and $Al_2O_3$ and which generally includes the melting points for said oxides as well as the melting isotherms that can be formed within said metal oxide system. Said phase diagram further includes already known binary phase compositions formed between $ZrTiO_4$ and $Al_2TiO_5$ as well as $ZrO_2$ and $Al_2TiO_5$. The particular fused metal oxide ceramic compositions found useful in accordance with the present invention are all located with an area defined in said phase diagram by the perimeter boundaries ABCDEF and with the preferred compositions being located within said area at points G, H, and I. It can be noted for the present ceramic compositions that a portion of the straight line JK which designates binary phase materials formed between $ZrTiO_4$ and $Al_2TiO_5$ on said phase diagram resides within said ABCDEF perimeter area whereas the preferred G, H, and I ceramics also found within said area are all ternary phase materials. The ABCDEF boundary perimeter lines defining ceramics found useful in accordance with the present invention are derived based upon consideration of the rheological constraints for a fused ceramic which can be formed in situ on a refractory metal x-ray target and thereafter retained as an adherent coating at the operating temperatures employed in modern x-ray tubes. The straight perimeter lines AF, FE, ED and DC approximately follow the 1700° isotherm while the straight perimeter line AB defines a minimum 10 percent $ZrO_2$ within the 1700° isotherm and the straight line BC falls along the maximum 30 percent $Al_2O_3$ within the 1700° isotherm. It will also be apparent from known compositional relationships in the depicted phase diagram that such defined ABCDEF perimeter area further designates an overall composition for the presently fused ceramic materials which extends from about 10 weight percent up to about 80 weight percent $TiO_2$, from about 10 weight percent up to about 60 weight percent $ZrO_2$, and from about 5 weight percent up to about 30 weight percent $Al_2O_3$. Similarly, the hereinabove defined preferred composition at point G constitutes a ceramic having 40 weight percent $TiO_2$, 40 weight percent $ZrO_2$, and 20 weight percent $Al_2O_3$ whereas the preferred point H ceramic comprises a fused material comprising 70 weight percent $TiO_2$, 20 weight percent $ZrO_2$, and 10 weight percent $Al_2O_3$. The especially preferred ceramic of the present invention shown at point I contains 50 weight percent $TiO_2$, 40 weight percent $ZrO_2$, and 10 weight percent $Al_2O_3$. It also follows from the foregoing explanation that all of the presently useful ceramic materials can be regarded as eutectic compositions for said overall ternary phase system by reason of exhibiting a lower initial melting point of approximately 1580° to 1590° C.

To further illustrate a typical preparation in situ for the above defined especially preferred fused metal oxide ceramic coating of the present invention, there can be deposited by plasma spraying on a selected surface region of an otherwise conventional refractory metal x-ray tube anode the finely powdered physical mixture having approximately 50 weight percent $TiO_2$, and 40 weight percent $ZrO_2$, and approximately 10 weight percent $Al_2O_3$. Preliminary surface preparation of said target member by sandblasting with $Al_2O_3$ grit improves final coating adherence whereas the flame spraying technique is typically carried out in an inert atmosphere such as argon gas or argon-helium gas mixtures. Said still unfused coating is thereafter heated in a conventional vacuum atmosphere furnace to a fusion temperature higher than the initial melting point occuring at 1620°-1680° C. at a vacuum of about $10^{-5}$ Torr or lower. Subsequent thermal emittance measurements for said final coating on a selected molybdenum alloy x-ray target were conducted with a Beckman spectrophotometer and yielded average room temperature values of 0.850 at a 2 micron wavelength which represented at least a five percent improvement over the prior art fused metal oxide coatings. Superior endurance in the thermal environment ordinarily experienced by said coated target during x-ray tube operation was also demonstrated by continued adherence of the coating to the refractory metal substrate as compared with the previously observed spalling or melting behavior frequently encountered with said prior art coatings.

Figure 2:
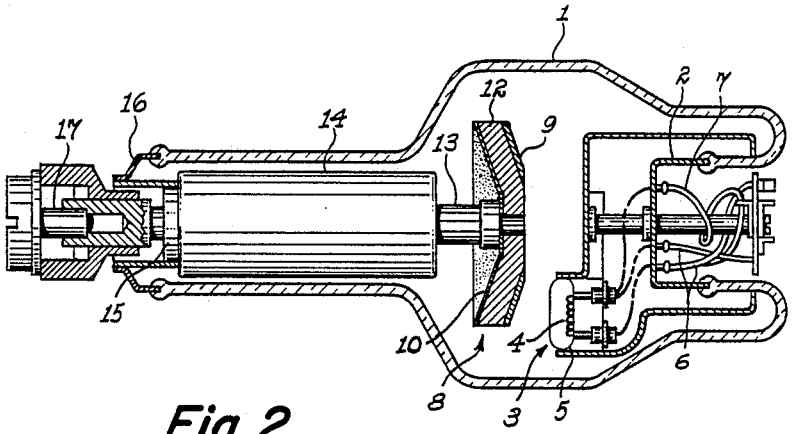
FIG. 2 is a typical rotating anode x-ray tube, shown in section, in which the present target coating material can be used.

A typical rotating CT tube of the above type which has been modified in accordance with the present invention to incorporate the ceramic coated x-ray target is depicted in FIG. 2. Accordingly, the illutrated x-ray tube comprises a glass envelope 1 which has a cathode support 2 sealed into one end. A cathode structure 3 comprises an electron emissive filament 4 and a focusing cup 5 is mounted to support 2. There is a pair of conductors 6 for supplying heating current to the filament and another conductor 7 for maintaining the cathode at ground or negative potential relative to the tube target. The anode or target on which the electron beam from the cathode 3 impinges to produce X radiation is generally designated by reference numerial 8. Target 8 will usually be made of refractory metal such as molybdenum or tungsten or alloys thereof. A surface layer on which the electron beam impinges while the target is rotating to produce x-rays is marked 9 and is shown in cross section in said FIG. 2. Surface layer 9 is commonly composed of tungsten - rhenium alloy to more effectively generate the desired x-rays. The rear surface 10 of the target 8 is concave in the illustrated embodiment, but can be concave, flat or convex, and is one of the surfaces on which the present high thermal emittance coating may be applied. The coating may also be applied to areas of the target outside of the focal spot track such as the peripheral surface 12 of the target. In FIG. 2, the target 8 is fixed on a shaft 13 which extends from a rotor 14. The rotor is journalled on an internal bearing support 15 which, in turn, is supported from a ferrule 16 that is hermetically sealed into the end of the glass tube envelope 1. The stator coils for driving rotor 14 as an induction motor are omitted from the present drawing. High voltage is supplied to the anode structure and target 8 by a supply line (not shown) coupled with a connector 17. As is well known, rotating anode x-ray tubes are usually enclosed within a casing (not shown) which has spaced apart walls between which oil is circulated to carry away the heat that is radiated from rotating target 8. As indicated above, the target reaches or exceeds 1400° C. during tube operation and most of this heat has to be dissipated by radiation through the vacuum within tube envelope 1 to the oil in the tube casing which may be passed through a heat exchanger (also not shown). It is common to coat the rotor 14 with a textured material such as titanium dioxide to increase thermal emittance and thereby prevent the bearings which support the rotor from becoming overheated. If the heat storage capacity of the target 8 is not great enough or if its cooling rate is low, duty cycles must be shortened which means that the tube must be kept deenergized until the target reaches a safe operating temperature. This often extends the time required for an x-ray diagnositc sequence. Hence it is important that the emittance of the target surface be maximized. $TiO_2$ is a typical prior art coating material for said rotor 14. It has a thermal emittance value of about 0.85 and is suitable for parts such as the rotor 14 which, if the target 8 emits heat sufficiently well, will operate at a safe temperature of 500° C. or below. Pure $TiO_2$, however, is not suitable for coating targets in high power x-ray tubes because it would deteriorate at temperatures attained by the target. It cannot be raised to fusion temperature in a vacuum without degradation. In operation, the foregoing described cathode and anode structural assemblies cooperate to generate X radiation within said glass envelope. Specifically, the electron emissive filament 4 is operatively associated with focusing cup 5 to focus an electron beam generated by said filament upon the refractory metal target in the anode structural assembly. The x-rays generated by said target surface region responsive to the impingement of said electron beam thereon produce the heat required to be dissipated by radiation with the present fused metal oxide ceramic coating.

Figure 3:
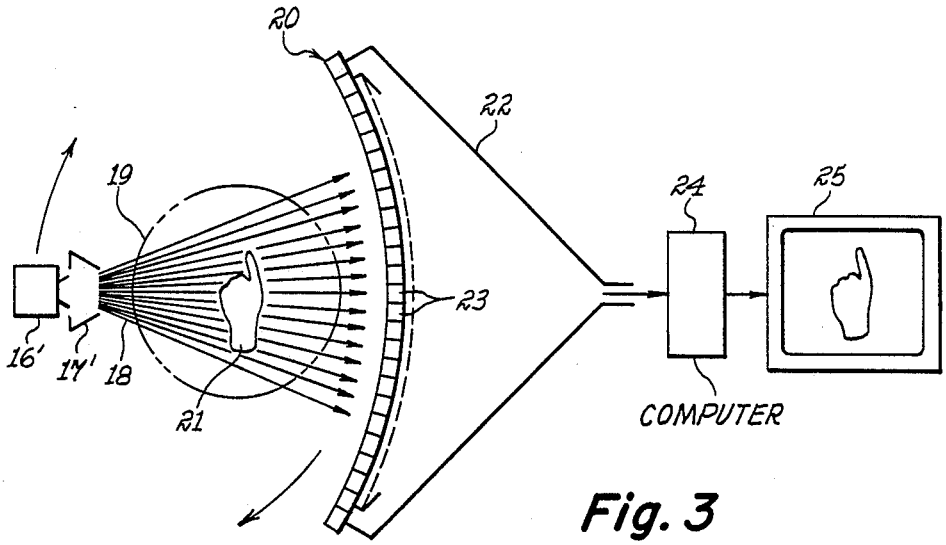
FIG. 3 is a schematic representation partially in block diagram form for a typical CT scanner system for production, transmission, and detection of X radiation utilizing the presently improved coating material.

Referring to FIG. 3, there is depicted partially in block diagram form a typical CT scanner for the production, transmission, and detection by X radiation which can utilize the rotating anode x-ray tube construction described above in connection with FIG. 2. This scanner includes such X radiation source 16', for producing the penetrating radiation and said radiation source 16' includes the x-ray target coating accordance with the present invention. The radiation produced by said x-ray source 16' is columnated by columator 17' to produce a thin beam of x-rays 18 which is projected through aperture 19 toward x-ray detector 20. A subject or body to be examined, such as subject 21 is positioned in the path of the fan beam of x-rays 18 in such a manner that the beam is attenuated as it passes through subject 21, with the amount of attenuation being dependent on the density of subject 21. Radiation detector 20 comprises detector array housing 22 having a plurality of channels 23 defined therein. Channels 23 are configured so as to receive the attenuated fan beam of x-rays 18 so as to produce electrical signals which are dependent on the density of the radiation received by each channel. The resulting electrical signals are therefore a measure of the attentuation of the x-ray beam by the portion of the body through which the beam has passed. In said X radiation detector, channels 23 typically comprise a plurality of collimated cells with each cell having an already known physical structure such as described in U.S. Pat. No. 4,525,628, also assigned to the present assignee. In operation, electrical signal readings are taken from each channel 23 at a plurality of angular positions with respect to subject 21, while x-ray source 16 and detector 20 are rotated about said subject. The resulting readings are digitized and transmitted to computer means 24, which uses one of a number of available algorithms to compute and construct a picture of the cross section traversed by the fan beam of x-rays 18. The resulting picture is displayed on cathode ray tube 25, or, alternately, can be used to create an image on permanent media such as photographic film or the like.

It will be apparent from the foregoing description that a broadly useful fused metal oxide ceramic coating has been discovered to improve thermal emittance of various coated articles requiring heat dissipation by radiation means. It will also be apparent from the foregoing description that the disclosed ceramic coatings particularly improve the performance characteristics of various x-ray tube and x-ray imaging devices. It will be further apparent from the foregoing description, however, that various modifications in the specific embodiments above described can be made without departing from the spirit and scope of the present invention. For example, it is contemplated that still other metal oxides can be added to the present ceramic coating compositions in minor amounts to facilitate processing of these coatings on the disclosed x-ray targets. Additionally, still other physical configurations of the above specifically disclosed x-ray tube and CT scanner equipment can employ the presently improved ceramic coatings. Moreover, it is still further contemplated that said ceramic coatings can be applied to x-ray targets by other methods. The starting metal oxides may be entrained in a suitable binder or other volatile fluid vehicle and sprayed or painted on the target surface. The oxides may also be vacuum sputtered in an inert gas or the metals forming said oxides may be vacuum sputtered in a partial pressure of oxygen to produce such oxide coatings. It is intended to limit the present invention, therefore, only by the scope of the following claims:

What I claim as new and desire to secure by Letters Patent of the United States is:

1. An x-ray tube anode comprising a refractory metal target with a surface region for being impinged by electrons to produce X radiation and a coating distinct from said region for enhancing the thermal emittance of said target, said coating consisting a fused metal oxide ceramic having a minimum melting point at approximately 1580° C. and fused at no greater then approximately 1750° C. so that an adherent coating is retained during anode operation, said fused metal oxide ceramic consisting essentially of $Al_2O_3$, $ZrO_2$, and $TiO_2$, except for incidental impurities.

2. The anode of claim 1 wherein the refractory metal target is a molybdenum alloy.

3. The anode of claim 1 wherein the refractory metal target is a tungsten alloy.

4. The anode of claim 1 wherein the refractory metal target is of composite construction having a refractory metal layer physically supported on a refractory substrate exhibiting greater thermal conductance.

5. The anode of claim 1 wherein the surface region of the refractory metal target coated with the metal oxide ceramic is roughened before coating.

6. The anode of claim 1 wherein the metal oxide ceramic comprises the composition within perimeter ABCDEF of FIG. 1.

7. The anode of claim 6 wherein the metal oxide ceramic consists essentially of from about 40 weight percent up to about 70 weight percent $TiO_2$, from about 20 weight percent up to about 40 weight percent $ZrO_2$ and from about 10 weight percent up to about 20 weight percent $Al_2O_3$, except for incidental impurities.

8. The anode of claim 7 wherein the metal oxide ceramic consists essentially of approximately 50 weight percent $TiO_2$, approximately 40 weight percent $ZrO_2$ and approximately 10 weight percent $Al_2O_3$, except for incidental impurities.

9. An x-ray tube anode comprising a refractory metal target with a surface region for being impinged by electrons to produce X radiation and a coating distinct from said region for enhancing thermal emittance of said target, said coating resulting from fusion in situ at a pressure of $10^{-5}$ Torr or lower and at a temperature no greater than approximately 1750° C. a metal oxide physical mixture consisting essentially of $Al_2O_3$, $ZrO_2$ and $TiO_2$ to produce a metal oxide ceramic exhibiting a minimum melting point of approximately 1580°C. which retains adherence to the coated anode during anode operation.

10. The anode of claim 9 wherein the metal oxide ceramic consists essentially of from about 40 weight percent up to about 70 weight percent $TiO_2$, from about 20 weight up to about 40 weight percent $ZrO_2$, and from about 10 weight percent up to about 20 weight percent $Al_2O_3$, except for incidental impurities.

11. The anode of claim 10 wherein the metal oxide ceramic consists essentially of approximately 50 weight percent $TiO_2$, approximately 40 weight percent $ZrO_2$, and approximately 10 weight percent $Al_2O_3$, except for incidental impurities.

12. A coating for enhancing thermal emittance of a refractory metal article to which said coating is applied, said coating comprising the fused product of heating a metal oxide physical mixture consisting essentially of $TiO_2$, $ZrO_2$, and $Al_2O_3$, except for incidental impurities to an elevated temperature no greater than approximately 1750° C. for a sufficient time period to fuse said mixture and provide a metal oxide ceramic with a minimum melting point of approximately 1580° C. which retains adherence to the coated refractory metal article when heated to elevated temperatures.

13. A coating as in claim 12 wherein the metal oxide ceramic consists essentially of from about 40 weight percent up to about 70 weight percent $TiO_2$, from about 20 weight percent up to about 40 weight percent $ZrO_2$, and from about 10 weight percent up to about 20 weight percent $Al_2O_3$, except for incidential impurities.

14. A coating as in claim 13 wherein the metal oxide ceramic consists essentially of approximately 50 weight percent $TiO_2$, approximately 40 weight percent $ZrO_2$, and approximately 10 weight percent $Al_2O_3$, except for incidental purities.

15. A coating as in claim 12 wherein said metal oxide physical mixture is first deposited on the surface of said article by plasma spraying in an inert atmosphere to produce an unfused product and thereafter fused at a temperature no greater than approximately 1750° C. in a vacuum atmosphere of $10^{-5}$ Torr or lower.

16. A coating as in claim 15 wherein said article being coated is a refractory metal x-ray tube anode.

17. A coating as in claim 16 wherein the surface of said refractory metal x-ray tube anode being coated is roughened before coating.

18. A method for producing a high thermal emittance coating on a refractory metal x-ray tube anode surface, said method including the steps of:

(a) depositing on selected surface regions of said anode a metal oxide mixture consisting essentially of $Al_2O_3$, $ZrO_2$ and $TiO_2$, except for incidential impurtities in weight proportions producing a fused ceramic having a minimum melting point of approximately 1580° C., and (b) heating said anode at a pressure of $10^{-5}$ Torr or lower at a temperature no greater than approximately 1750° C. for a sufficient time to fuse said metal oxide mixture and provide a coating which retains adherence during anode operation.

19. A method as in claim 18 wherein said metal oxide mixture consists essentially of from about 40 weight percent up to about 70 weight percent $TiO_2$, from about 20 weight percent up to about 40 weight percent $ZrO_2$, and from about 10 weight percent up to about 20 weight percent $Al_2O_3$, except for incidental impurities.

20. A method as in claim 19 wherein said metal oxide mixture consists essentially of approximately 50 weight percent $TiO_2$, approximately 40 weight percent $ZrO_2$, and approximately 10 weight percent $Al_2O_3$, except for incidental impurities.

21. A method as in claim 18 wherein said refractory metal x-ray tube anode surface being coated is roughened before coating.

22. A method as in claim 21 wherein the roughening of said refractory metal x-ray tube anode surface is achieved by sandblasting.

23. A method as in claim 18 wherein said metal oxide mixture is deposited on the x-ray tube anode surface by spraying with a plasma gun.

24. An improved rotating anode x-ray tube construction comprising:

(a) a sealed evacuated glass envelope incorporating cathode and anode structural assemblies to generate X radiation within said glass envelope, (b) said cathode structural assembly including an electron emissive filament operatively associated with means to focus an electron beam generated by said filament upon the anode structural assembly, (c) said anode structural assembly including a refractory metal target for impingement of said electron beam thereon to produce X radiation, and (d) further structural means disposed within said glass envelope to cause relative rotation between said cathode assembly and refractory metal target, wherein the improvement comprises providing a surface coating from the region impinged by said electron beam to enhance the thermal emittance from said target, said surface coating consisting of a fused metal oxide ceramic having a minimum melting point of approximately 1580° C. and fused at no greater than approximately 1750° C. so that an adherent coating is retained during operation of the refractory metal target, said fused metal oxide ceramic consisting essentially of $TiO_2$, $ZrO_2$ and $Al_2O_3$, except for incidental impurities.

25. A rotating anode x-ray tube as in claim 24 wherein the cathode assembly remains stationary during tube operation and the anode assembly rotates with respect thereto.

26. A rotating anode x-ray tube as in claim 24 wherein the fused metal oxide ceramic consists essentially of from about 40 weight percent up to about 70 weight percent $TiO_2$, from about 20 weight percent up to about 40 weight percent $ZrO_w$, and from about 10 weight percent up to about 20 weight percent $Al_2O_3$, except for incidental impurities.

27. A rotating anode x-ray tube as in claim 24 wherein the fused metal oxide ceramic consists essentially of approximately 50 weight percent $TiO_2$, approximately 40 weight percent $ZrO_2$, and approximately 10 weight percent $Al_2O_3$, except for incidental impurities.

28. A rotating anode x-ray tube as in claim 26 wherein said coating results from fusing in situ at a pressure of $10^{-5}$ Torr or lower and at a temperature no greater than approximately 1750° C. a metal oxide physical mixture consisting essentially of $TiO_2$, $ZrO_2$ and $Al_2O_3$, except for incidental impurities, wherein said metal oxide ceramic further exhibits a minimum melting point of approximately 1580° C. and remains adherent to the refractory metal target during operation.

29. In a radiographic imaging system utilizing a rotating anode x-ray tube, a scintillator body to convert the x-rays to an optical image, and photodetection means coupled thereto for converting said optical image to an electronic display thereof, the improvement wherein the anode of said x-ray tube comprises a refractory metal target with a surface region for impingement of electrons thereon to produce X radiation and a coating distinct from said region for enhancing the thermal emittance of said target, the improvement wherein said coating consists of a fused metal oxide ceramic having a minimum melting point of approximately 1580° C. and fused at no greater than approximately 1750° C. so as to remain adherent to the refractory metal target during operation, said fused metal oxide ceramic consisting essentially of $TiO_2$, $ZrO_2$ and $Al_2O_3$, except for incidental impurities.

30. A radiographic imaging system as in claim 29 wherein the fused metal oxide ceramic consists essentially of from about 40 weight percent up to about 70 weight percent $TiO_2$, from about 20 weight percent up to about 40 weight percent $ZrO_2$, and from about 10 weight percent up to about 20 weight percent $Al_2O_3$, except for incidental impurities.

31. A radiographic imaging system as in claim 30 wherein the fused metal oxide ceramic consists essentially of approximately 50 weight percent $TiO_2$, approximately 40 weight percent $ZrO_2$ and approximately 10 weight percent $Al_2O_3$, except for incidental impurities.

32. A radiographic imaging system as in claim 29 which further includes means for digital recording of said optical image.

33. A radiographic imaging system as in claim 29 which further includes digital processing means to enhance the quality of said optical image.

* * * * *